United States Patent [19]

Smith

[11] 3,978,822

[45] Sept. 7, 1976

[54] VAPOR GENERATOR

[75] Inventor: John William Smith, Massillon, Ohio

[73] Assignee: The Babcock & Wilcox Company, New York, N.Y.

[22] Filed: Aug. 4, 1975

[21] Appl. No.: 601,910

[52] U.S. Cl. ..... 122/510; 122/494

[51] Int. Cl.[2] ..... F22B 37/24

[58] Field of Search..... 122/7 R, 336, 478, 494, 122/510

[56] References Cited

UNITED STATES PATENTS

| | | | |
|---|---|---|---|
| 2,774,340 | 12/1956 | Jankowski | 122/510 |
| 2,939,435 | 6/1960 | Kessler | 122/478 |
| 3,022,774 | 2/1962 | Hamilton et al. | 122/478 |
| 3,209,734 | 10/1965 | Cooper et al. | 122/510 |
| 3,212,481 | 10/1965 | Mumford et al. | 122/510 |
| 3,368,536 | 2/1968 | Sullivan | 122/510 |

*Primary Examiner*—Kenneth W. Sprague
*Attorney, Agent, or Firm*—J. M. Maguire; R. J. Edwards

[57] ABSTRACT

A bottom supported vapor generator having tubular platens communicating with upper and lower headers and including rigid members fixedly connecting the lower headers to a grid slidably supported on concrete pedestals.

7 Claims, 4 Drawing Figures

VAPOR GENERATOR

BACKGROUND OF THE INVENTION

The present invention relates to steam generators and more particularly to a support arrangement for bottom supported steam generating units.

A bottom supported unit is one where the pressure parts are supported from lower headers resting on upright columns positioned therebeneath. It has been the practice to station columns at the ends of respective headers and to provide the columns with bearing plates and the headers with saddle supports and to insert graphite lubricated pads between corresponding bearing plates to accommodate lateral and longitudinal thermal expansion of the unit as it is brought up to operating temperature.

This has proven to be a costly support structure particularly as related to horizontally disposed units having a relatively large number of vertical tube platens which are individually supported from separate lower headers.

SUMMARY OF THE INVENTION

The present invention is directed at a support arrangement for a steam generator having a large number of bottom supported lower headers, and obviates the need for providing costly slidable supports at each of the headers to accommodate movement due to thermal expansion. The invention permits the use of inexpensive fixed supports to connect the headers to a grid which is in turn supported by a relatively few slidable supports.

Accordingly, there is provided a bottom supported steam generator having walls defining a gas passage and means for introducing heating gases through the passage. Upright tubes are disposed within the passage with at least some of the tubes forming a plurality of platens arranged parallel to one another in a direction transverse to the gas flow. Each of the platens has its upper and lower ends connected to headers. A bottom support arrangement is provided for supporting the upper headers and the tubular platens through corresponding lower headers. The bottom support arrangement comprises an insulated grid formed of horizontally disposed intersecting structural members and includes relatively short upright pipe members fixedly connecting the grid and lower headers. The grid is mounted on concrete pedestals and includes slidable plate means disposed therebetween to accommodate lateral and longitudinal thermal expansion of the steam generator as it is brought up to operating temperature.

DETAILED DESCRIPTION OF THE PREFERRED EMBODIMENT

Figure 1:
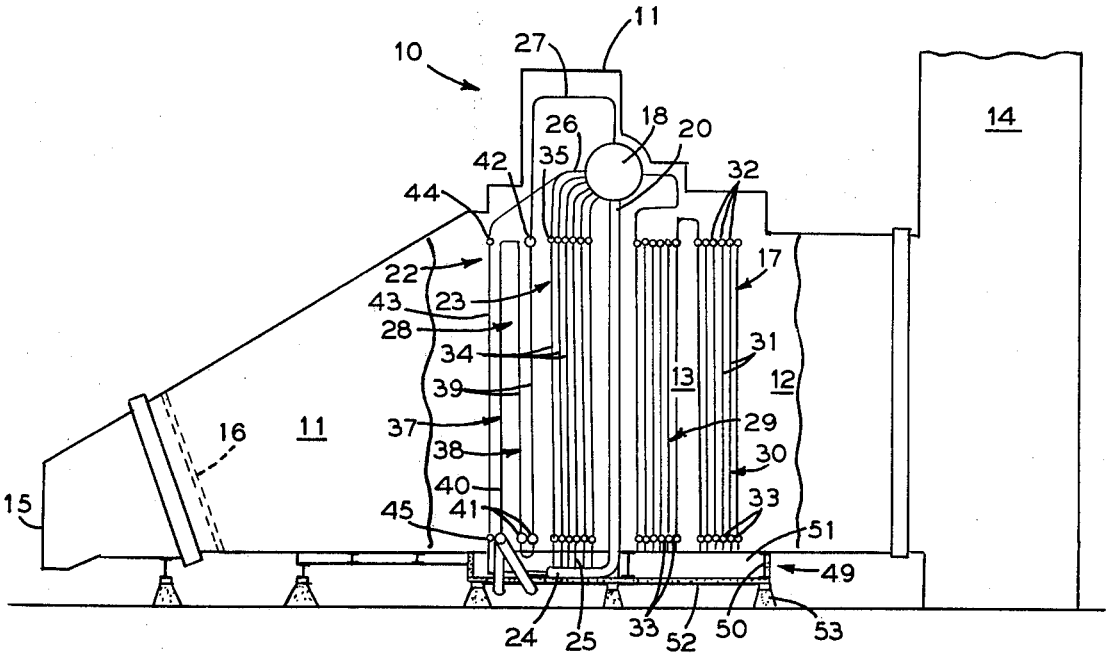
FIG. 1 is a sectional side elevation of a waste heat type steam generator embodying the invention.

Referring to the drawings, there is illustrated a natural circulation type steam generator 10 used in the recovery of waste heat from gas turbine exhaust gases.

The waste heat steam generator 10 is provided with a setting 11 having a refractory lined metal casing and arranged for generally horizontal, single pass gas flow therethrough.

The setting 11 includes inlet and outlet ducts 11 and 12 and a boiler section 13 interposed therebetween, and a stack 14 for discharging the gases exiting from the outlet duct 12. The inlet duct 11 is provided with an opening 15 to admit the heating gases to the steam generator 10 and an auxiliary fuel burner 16 to be used to raise the incoming heating gas temperature should that temperature drop below the required value.

The pressure parts of the steam generator 10 are located in the boiler section 13 and comprise an economizer 17 which discharges into the water space of a steam drum 18. Downcomers 20 are spaced along the longitudinal extent of the drum 18 and communicate with the water space to convey water therefrom to a tube screen 22 and a generating tube bank 23 through corresponding supply headers and pipes 24 and 25. The tube screen and generating bank 22 and 23 discharge through riser tubes 26 into the steam space of the drum 18. Saturated steam leaves the drum 18 through steam pipes 27 which discharge into a superheater 28.

The economizer, generating bank, superheater and screen heat exchange surfaces comprise upright platens containing one or more rows of tubes connected to upper and lower headers. The platens are arranged parallel to one another in a direction transverse to the gas flow.

The economizer 17 comprises two banks 29 and 30 spaced in the direction of gas flow. Each of the banks 29 and 30 is formed of three modules 17A, 17B and 17C spaced in a direction transverse to the gas flow. Each of the modules 17A-B-C contains six platens 31 spaced in the direction of gas flow and connected to corresponding upper and lower headers 32 and 33.

The generating bank 23 is formed of three modules 23A, 23B and 23C spaced in a direction transverse to the gas flow. Each of the modules 23A-B-C contains six platens 34 spaced in the direction of gas flow and connected to corresponding upper and lower headers 35 and 36.

The superheater 28 comprises two banks 37 and 38 spaced in the direction of gas flow. Each of the banks 37 and 38 is formed of three modules 28A, 28B and 28C spaced in a direction transverse to the gas flow. Each of the modules 28A-B-C of the bank 38 contains two platens 39 spaced in the direction of gas flow and each of the modules 28A-B-C of the bank 37 contains one platen 40. Each of the platens 39 and 40 is connected to corresponding lower headers 41 and each of the rear platens 39 of bank 38 are connected to corresponding upper headers 42.

The screen 22 is formed of three modules 22A, 22B and 22C spaced in a direction transverse to the gas flow. Each of the modules contains one platen 43 connected to upper and lower headers 44 and 45.

Thus, we see that the heat exchange surfaces in boiler section 13 are connected to a total of 66 bottom supported lower headers which will be subjected to lateral and longitudinal movement due to thermal expansion as the steam generator 10 is brought up to operating temperature. Since it is normal practice to provide each header with a support stationed near each of its opposite ends, a steam generator of the type under consideration would require a total of 132 supports. Such a structure is very costly since each support would require saddles, bearing plates and graphite lubricated pads to accommodate the header movement due to thermal expansion.

In accordance with the support structure of the present invention, the supports 48 stationed near the ends of each lower header are welded to the header and are preferably in the form of short heavy wall pipes having dished upper ends conforming to the header contour. The lower ends of the pipe supports 48 are fixedly connected to a grid support 49 through the stops 61.

The grid 49 is located beneath the boiler section 13 and is comprised of horizontally disposed intersecting structural members preferably in the form of I-beams and includes three lateral beams 50 spanning the width the boiler section 13 and being spaced from one another in the direction of gas flow and six longitudinal beams 51 extending across each of the spaces between the lateral beams 50. The longitudinal beams 51 have their opposite ends contoured to fit within the receiving webs of the lateral beams 50. The intersecting beams 50 and 51 are fixedly interconnected through the bolting or welding of adjoining surfaces.

The grid 49 is fixedly connected to the lower headers through the support members 48 and the two are encased by insulation 52 so as to be at or near the temperature of the supported headers. Thus, as the steam generator 10 is brought up to operating temperature, the grid 49 will experience thermal expansion substantially commeasurate to the supported headers. The entire grid is supported from only 18 foundation pedestals or piers 53, the latter being located at the points of intersection between the lateral and longitudinal beams 50 and 51.

Figure 4:
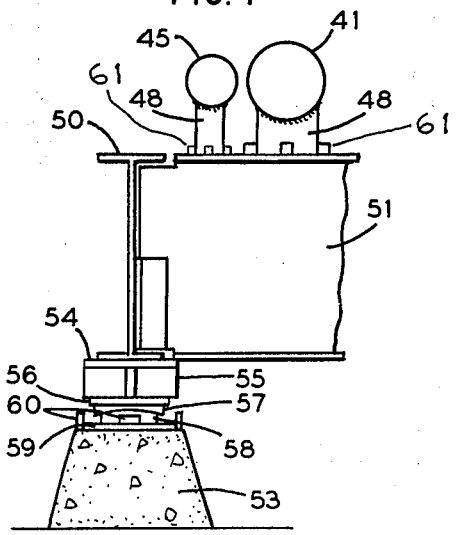
FIG. 4 is a detail view of the bottom support arrangement.
Figure 2:
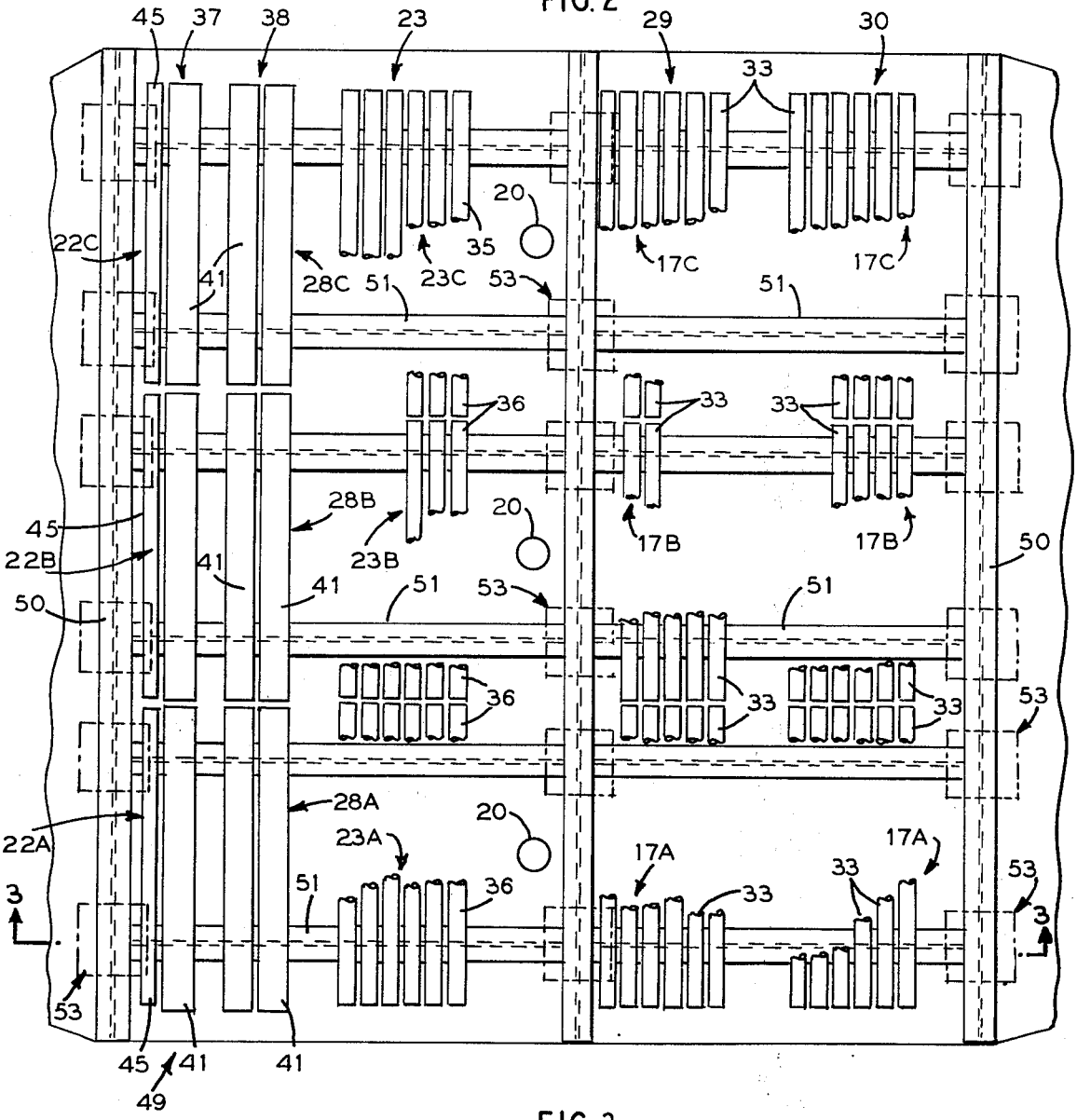
FIG. 2 is a plan view of the bottom support arrangement.
Figure 3:
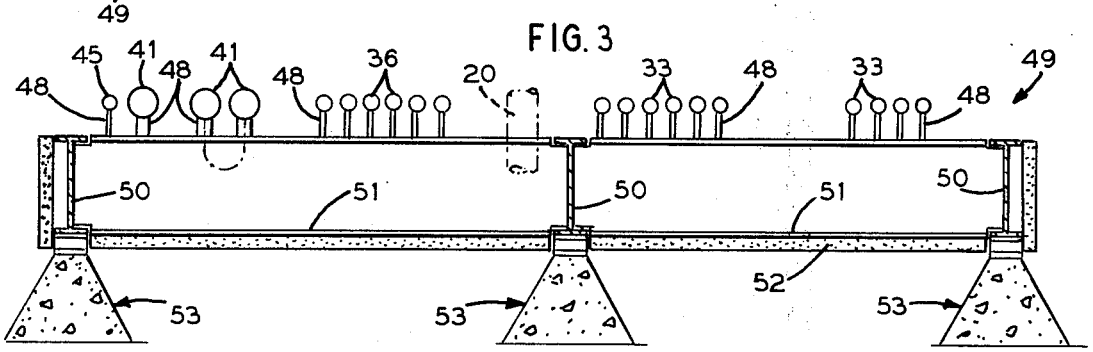
FIG. 3 is a sectional view taken along line 3—3 of FIG. 2.

Referring particularly to FIG. 4, there is shown the screen and superheater lower headers 45 and 41 weldably connected to the support members 48 with the latter being in turn fixedly connected to the top flange of longitudinal beam 51. The beam 51 has its end section contoured to fit within the web of the lateral beam 50 and is fixedly connected thereto. The beam 50 has its bottom flange fixedly connected to the upper bearing plate 54 of a cross webbed support member 55. The lower bearing plate 56 of the support member 55 is fitted with a sole plate 57 which engages a graphite lubricated pad 58. The foundation pedestal 53 is topped by a bearing plate 59 which is anchored thereto and provides a sliding surface for the pad 58 thereby accommodating the movement resulting from the thermal expansion of the grid 49 and supported heating surfaces as the steam generator is brought up to operating temperature. Stops 60 are provided to prevent movement other than that occasioned by thermal expansion.

In the operation of the steam generator 10, turbine exhaust gases are introduced through the opening 15 for generally horizontal flow through the inlet duct 11 to a boiler section 13 and thence through an outlet duct 12 for discharge through the stack 14. The auxiliary burner 16 is fired in the event that the exhaust gas temperature is below the required value. At the same time feedwater is preheated through the economizer 17 and flows into the water space of drum 18 from whence it is conveyed by the downcomers 20 to the screen and generating tube banks 22 and 23. The saturated steam leaving the banks 22 and 23 enters the steam space of drum 18 wherein it is freed of entrained moisture before being conveyed to the superheater 28.

While in accordance with provisions of the statutes there is illustrated and described herein a specific embodiment of the invention, those skilled in the art will understand that changes may be made in the form of the invention covered by the claims, and that certain features of the invention may sometimes be used to advantage without a corresponding use of the other features.

The embodiments of the invention in which an exclusive property or privilege is claimed are defined as follows:

1. A bottom supported steam generator having walls defining a gas passage, means for introducing heating gases through said passage, upright tubes disposed within said passage, at least some of the tubes forming a plurality of spaced platens arranged parallel to one another in a direction transverse to the gas flow, each of said platens having its lower end connected to header means, and means for bottom supporting said header means, the bottom support means comprising a grid formed of intersecting structural members, means fixedly connecting said grid and header means, the grid being mounted on pedestals, and including slidable plate means interposed therebetween.

2. The bottom supported steam generator according to claim 1 wherein said grid is encased in insulation.

3. The bottom supported steam generator according to claim 1 wherein said structural members are in the form of I-beams.

4. The bottom supported steam generator according to claim 1 wherein the connecting means between said grid and header means include pipe members fixedly connected thereto.

5. The bottom supported steam generator according to claim 1 wherein the grid includes lateral structural members extending across the width of the gas passage and spaced from one another in the direction of gas flow.

6. The bottom supported steam generator according to claim 5 including longitudinal structural members extending across the space between adjoining lateral members, said longitudinal and lateral members being fixedly interconnected.

7. The bottom supported steam generator according to claim 6 wherein the pedestals are located subjacent to the point of intersection between the lateral and longitudinal structural members.

* * * * *